US008622206B2

(12) United States Patent
Miller et al.

(10) Patent No.: US 8,622,206 B2
(45) Date of Patent: Jan. 7, 2014

(54) PEEL-TO-OPEN PACKAGES

(75) Inventors: Christopher Miles Miller, Hamilton, OH (US); Randy Joseph Lakes, Loveland, OH (US); Matthew Joshua Brewer, Batavia, OH (US); Barbara Ann Cappel, Monroe, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1176 days.

(21) Appl. No.: 11/825,173

(22) Filed: Jul. 5, 2007

(65) Prior Publication Data

US 2008/0063325 A1 Mar. 13, 2008

Related U.S. Application Data

(60) Provisional application No. 60/843,179, filed on Sep. 8, 2006.

(51) Int. Cl.
*A61B 19/02* (2006.01)

(52) U.S. Cl.
USPC ..... 206/63.5; 206/813

(58) Field of Classification Search
USPC ..... 206/63.5, 438, 440, 460, 813
See application file for complete search history.

(56) References Cited

U.S. PATENT DOCUMENTS

| | | | | |
|---|---|---|---|---|
| 3,123,210 | A * | 3/1964 | Hermanson et al. | 206/439 |
| 3,326,450 | A | 6/1967 | Langdon | |
| 3,552,638 | A * | 1/1971 | Quackenbush | 206/484 |
| 3,604,616 | A * | 9/1971 | Greif | 206/439 |
| 3,655,129 | A | 4/1972 | Seiner | |
| 3,724,651 | A * | 4/1973 | Link | 206/440 |
| 3,750,937 | A | 8/1973 | Goodwin | |
| 3,850,124 | A | 11/1974 | Brown | |
| 3,926,309 | A * | 12/1975 | Center | 206/438 |
| 3,926,311 | A | 12/1975 | Laske | |
| 4,003,493 | A | 1/1977 | Wells | |
| 4,145,001 | A | 3/1979 | Weyenberg | |
| 4,158,440 | A | 6/1979 | Sullivan | |
| 4,182,449 | A | 1/1980 | Kozlow | |
| 4,681,228 | A | 7/1987 | Kerry | |
| 4,700,838 | A | 10/1987 | Falciani | |
| 4,720,417 | A | 1/1988 | Sweeny | |
| 5,088,703 | A | 2/1992 | Takano | |
| 5,164,178 | A | 11/1992 | Muysson | |
| 5,253,754 | A | 10/1993 | Soodak | |
| 5,487,932 | A | 1/1996 | Dunshee | |

(Continued)

FOREIGN PATENT DOCUMENTS

| | | |
|---|---|---|
| DE | 19817206 | 10/1999 |
| GB | 1013737 | 12/1965 |
| WO | WO 93/11054 | 6/1993 |
| WO | WO 98/56686 | 12/1998 |

*Primary Examiner* — Andrew Perreault
(74) *Attorney, Agent, or Firm* — Angela K. Haughey; Kathleen Y. Carter; James E. Oehlenschlager

(57) ABSTRACT

Improved peel-to-open packages including sachets, pouches, and the like are disclosed. The packages are made of substrate layers removably adhered together using an adhesive pattern of seal(s) that are characterized by peel forces. The adhesive pattern is designed to provide for controlled opening of the packages, in some embodiments to a predetermined stopping point, such that any product(s) contained therein are presented to the consumer for removal. Further design features include, but are not limited to, offset tabs, textures, color variations and text, which may further provide for easy, intuitive opening.

24 Claims, 15 Drawing Sheets

(56) References Cited

U.S. PATENT DOCUMENTS

| | | | | |
|---|---|---|---|---|
| 5,549,201 | A * | 8/1996 | Braude | 206/63.5 |
| 5,623,813 | A | 4/1997 | Ma | |
| 5,637,401 | A | 6/1997 | Berman | |
| 5,826,737 | A | 10/1998 | Zakensberg | |
| 5,945,145 | A * | 8/1999 | Narsutis et al. | 426/123 |
| 5,961,043 | A | 10/1999 | Samuelson | |
| 6,080,456 | A | 6/2000 | Fonteyne | |
| 6,213,767 | B1 | 4/2001 | Dixon | |
| 6,296,389 | B1 * | 10/2001 | Yamamoto et al. | 206/484 |
| 6,360,477 | B1 | 3/2002 | Flashinski | |
| 6,482,003 | B2 | 11/2002 | Dixon | |
| 6,568,533 | B1 * | 5/2003 | Tanaka et al. | 206/484 |
| 6,612,769 | B2 | 9/2003 | Lee | |
| 6,916,463 | B2 * | 7/2005 | Lee et al. | 424/53 |
| 7,422,105 | B2 * | 9/2008 | Loyd et al. | 206/438 |
| 2005/0074716 | A1 * | 4/2005 | Cleary et al. | 206/63.5 |
| 2005/0279649 | A1 * | 12/2005 | Thacker | 206/63.5 |
| 2006/0054514 | A1 | 3/2006 | Tokarski | |
| 2006/0054515 | A1 | 3/2006 | Corcoran | |
| 2006/0138019 | A1 * | 6/2006 | Yoshii et al. | 206/714 |
| 2007/0134622 | A1 * | 6/2007 | Rajaiah et al. | 433/168.1 |
| 2007/0185233 | A1 | 8/2007 | Rajaiah | |
| 2007/0185236 | A1 | 8/2007 | Rajaiah | |
| 2008/0011636 | A1 * | 1/2008 | St. John et al. | 206/449 |

* cited by examiner

PEEL-TO-OPEN PACKAGES

CROSS REFERENCE TO RELATED APPLICATION

This application claims the benefit of U.S. Provisional Application No. 60/843,179, filed Sep. 8, 2006.

FIELD OF THE INVENTION

Peel-to-open packages including, but not limited to, sachets, pouches, and the like.

BACKGROUND OF THE INVENTION

Difficult to open packages can be of concern to consumers, particularly those with limited manual dexterity and/or eyesight. Although a product may be excellent, if it is in a package that is hard to open, a consumer may settle for another product that is in an easier to open package.

Products, especially those that are small and/or intended for a single use, are traditionally packaged in sachets and the like. Sachets generally comprise two layers that are releasably held together with a seal or seals to form an interior cavity. The interior cavity may contain products such as towelettes, creams, medicaments, adhesive strips, ointments, and the like.

The layers of a sachet may be peeled apart in order to access the product within. This is typically accomplished by gripping a sachet at one end by each of its layers and exerting a pulling force. As the peel force(s) of the sachet's seal(s) are overcome by the pulling force, the sachet's layers are separated, and the product is ideally exposed to the consumer for removal.

Sachets that are currently used for packaging products typically have a seal or seals with constant peel forces located along the longitudinal side edges of the sachet. If a constant pulling force is exerted to peel apart the layers of this type of sachet, momentum may be gained such that the rate of peeling increases as the sachet progressively opens. A momentum gain can have several negative consequences. For example, when the other end of the sachet is reached, the layers may unintentionally be peeled completely apart. As a result, the product may simply fall out of the sachet. If the pulling force is great enough, the product may be ejected some distance from the sachet. In either case, the consumer is relegated to searching for, finding and picking up the product before it may be used. This can be particularly difficult in an environment with low lighting, high moisture and/or if the product has landed in a hard to reach area such as a sink drain. The difficulty may be compounded by a consumer's limited vision and/or manual dexterity.

There remains a need for packages including sachets and the like that may be peeled open in a controlled fashion to expose the product within for removal by the consumer. There remains a need for such packages to have an easily identifiable means of opening. There remains a need for such packages to have grip tabs that provide a means of peeling the packages open in moist environments such as bathrooms.

SUMMARY OF THE INVENTION

The present invention provides improvements in the packaging of products, particularly small ones, including, but not limited to, oral care substances such as denture adhesives.

The present packages include peel-to-open sachets, pouches, and the like and are hereinafter collectively referred to as "packages".

The present packages are made of a first layer and a second layer removably attached together using an adhesive pattern of seal(s) that are characterized by peel forces. The adhesive pattern is designed to provide for controlled opening of the packages. In some embodiments, the adhesive pattern provides for controlled opening of the packages to a predetermined stopping point, such that at least a portion of any product(s) optionally contained therein are presented to the consumer for removal. Further design features include, but are not limited to, offset tabs, textures, color variations, text or combinations thereof, which may further provide for easy, intuitive opening.

In one embodiment, the invention is directed to a package comprising a first layer and a second layer that are disposed in a face to face relationship such that a cavity is defined between the layers. The package is shaped such that it has a first end and a second end distal therefrom, with first and second opposing longitudinal side edges extending between the first and second ends. The two layers of the package are connected at the second end of the package, and are removably attached by an adhesive pattern comprising: a first seal disposed proximate to the first end of the package; a second seal disposed proximate to the first opposing longitudinal side edge; and a third seal disposed proximate to the second opposing longitudinal side edge. Each seal is characterized by a peel force. At least one of the second and third seals has a variable peel force, meaning that the peel force increases between the first and second ends of the package.

In some embodiments, the packages further comprise grip tabs, which are located at the first end of the package. The grip tabs may be present in a variety of configurations. For example, the grip tabs may be provided in a variety of shapes, textures, colors, degrees of transparency and spatial orientations relative to each another.

In some embodiments, the packages may contain oral care substances including, but not limited to denture adhesives.

In further embodiments, the invention is directed to a secondary package comprising a plurality of primary packages such as those described above. The primary packages may contain oral care substances, including but not limited to, denture adhesive.

These and other embodiments, aspects and advantages are encompassed within the present invention, and will become better understood with regard to the following description, figures and appended claims.

BRIEF DESCRIPTION OF THE DRAWINGS

The accompanying figures show non-limiting embodiments of improved packages incorporating various aspects of the present invention.

FIGS. 13-20 are plan and side views showing how the packages of the present invention may be peeled open.

DETAILED DESCRIPTION OF THE INVENTION

Figure 1:
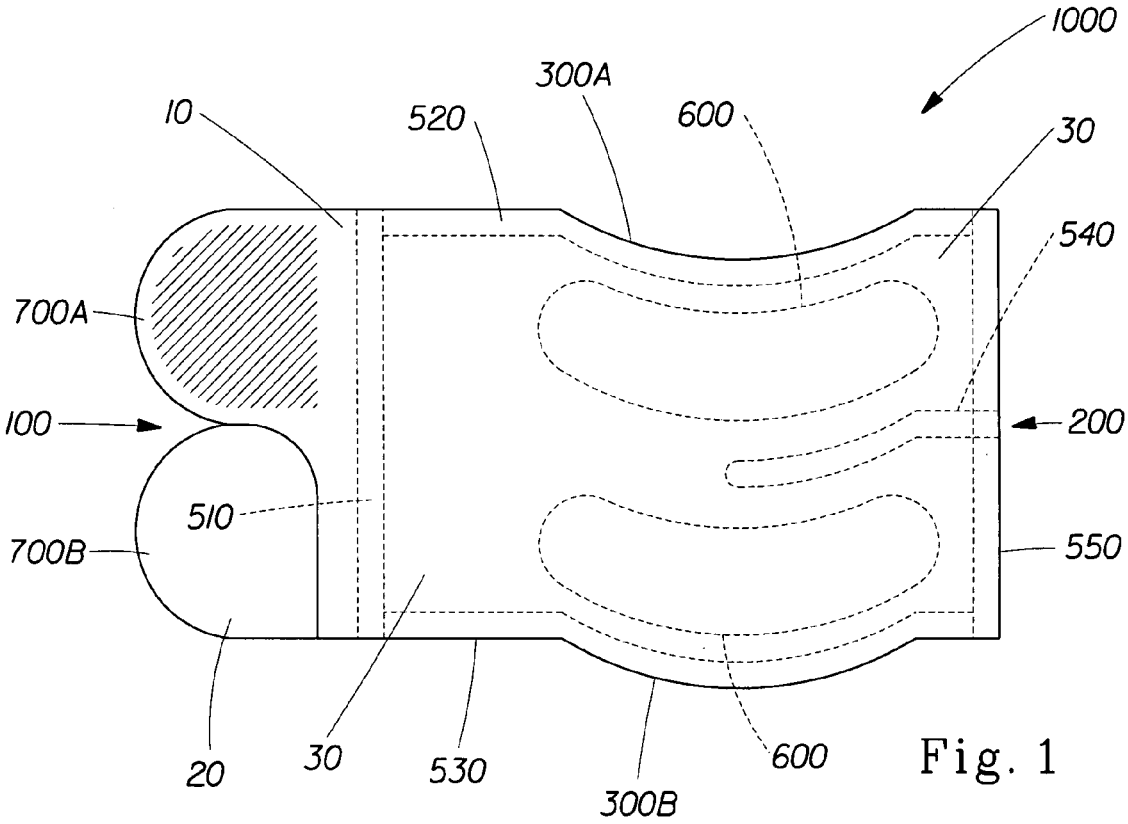
FIGS. 1-5 are plan views of packages according to the present invention.

"Opposing" as used herein means being across from each other in a given plane.

"Longitudinal" as used herein means running lengthwise.

"Extending" as used herein means spanning an interval of distance.

"Removably attached" as used herein means held together but separable by applying a force.

"Cavity" as used herein means a space suitable for containing product(s) therein.

"Seal" as used herein means something that acts as a fastener, and may provide a tight closure, such as between a first and a second layer.

"Peel force" as used herein means the amount of force required to cause at least a portion of an adhesive seal to fail, such that the portions of the first and second layers that had been fastened together by the seal separate. Peel force is measured as described in the Methods section infra.

"Adjoining seals" as used herein is meant to encompass one seal with variable peel strengths, or a series of seals that appear connected to the naked eye with 20/20 vision when viewed at a distance of 12 inches, or 30.48 centimeters, under the unimpeded light of an ordinary incandescent 60 watt light bulb that is inserted in a fixture such as a table lamp.

"Discrete seals" as used herein is meant to encompass seals that do not appear connected to the naked eye with 20/20 vision when viewed under the aforementioned conditions.

"Intersecting" as used herein means divided into two parts, which may be equal or unequal.

"Substrate" as used herein means any material, or group of materials that are used to form a layer of a package.

"Opaque" as used herein means not clear, i.e., not transmitting or reflecting light.

"Transparent" as used herein means clear, i.e., transmitting light.

"Translucent" as used herein means allowing light to pass through diffusely.

"Comprising" as used herein means that the various components, ingredients or steps may be conjointly employed in practicing the present invention. Accordingly, the term "comprising" is open-ended and encompasses the more restrictive terms "consisting essentially of" and "consisting of".

All numerical ranges disclosed herein, are meant to encompass each individual number within the range and to encompass any combination of the disclosed upper and lower limits of the ranges.

Referring to FIGS. 1-5, various embodiments of the packages 1000 of the present invention are shown. Each package 1000 comprises a first layer 10 and a second layer 20 that are disposed in a face to face relationship. A cavity 30 is defined between the first and second layers 10, 20 such that a product or products 600 (shown in phantom) may optionally be contained therein. Each package 1000 is shaped such that it has a first end 100 and a second end 200 distal therefrom, with first and second opposing longitudinal side edges 300A, 300B extending between the first and second ends. The two layers 10, 20 of each package 1000 are connected in a face to face relationship at the second end 200 of the package and are removably attached by an adhesive pattern comprising: a first seal 510 disposed proximate to the first end of the package 1000; a second seal 520 disposed proximate to the first opposing longitudinal side edge 300A of the package; and a third seal 530 disposed proximate to the second opposing longitudinal side edge 300B of the package (each seal is shown in phantom). Each seal is characterized by a peel force. The peel force of at least one of the second and third seals 520, 530 is variable, meaning that the peel force increases between the first end 100 and second end 200 of each package 1000.

Figure 6:
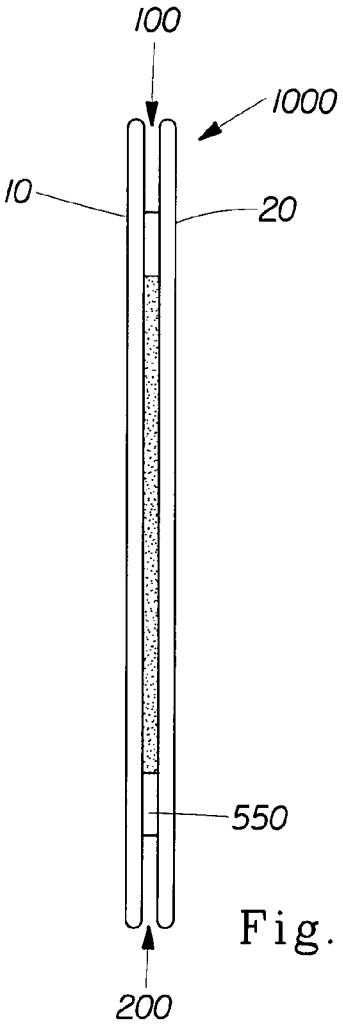
FIG. 6 is a side view of an embodiment in which the package comprises two layers formed from two separate pieces of substrate that are connected by a fifth seal.
Figure 7:
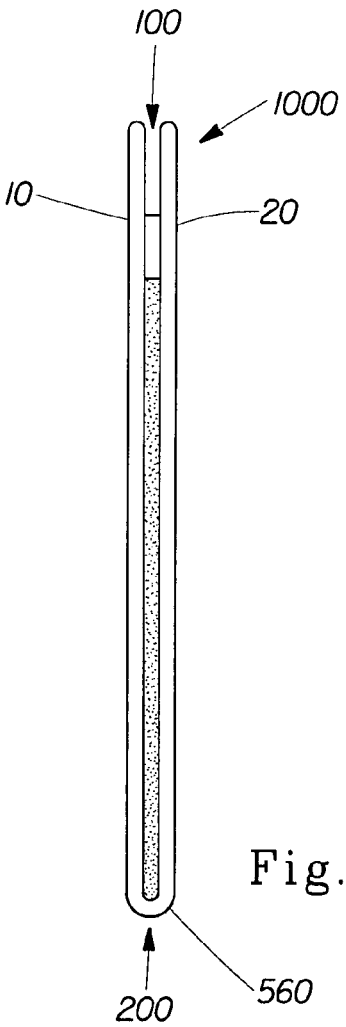
FIG. 7 is a side view of an embodiment in which the package is a single piece of substrate folded onto itself.

Referring now to FIGS. 6 and 7, the packages 1000 of the present invention comprise a first layer 10 and a second layer 20. The layers of the packages may be formed and connected in any appropriate way as determined by one of skill in the art. For example, in one embodiment two separate pieces of substrate form the first and second layers 10, 20 which are connected together at the second end 200 of the package 1000 using what is termed herein as the "fifth seal" 550, as shown for example from a side view in FIG. 6. The two separate pieces of substrate may be identical or different in composition. In another embodiment, a single piece of substrate is folded onto itself forming the first and second layers 10, 20 which are connected together at the second end 200 of the package 1000 by virtue of the resulting fold 560, as shown for example from a side view in FIG. 7.

Any suitable substrate is of use as the first and second layers of the present packages and may be chosen by one of skill in the art based upon one or a combination of factors. Non-limiting examples of factors include the product(s) to be contained in the package, storage conditions, shipping conditions, conditions under use, aesthetics, visual differentiation between the layers, and the like. For example, if the product is sensitive to light, opaque substrates are of use. If, for example, the package is to be stored or shipped at high temperatures, substrates that will withstand heat are desirable. If for example, the product is sensitive to moisture, substrates that are moisture impervious are desirable. Non-limiting examples of moisture impervious substrates of use in the present invention include foil laminates, foil/polymer laminates or co-extrusions, metals, polymers, metalized films, clear plastics or combinations thereof.

Figure 8:
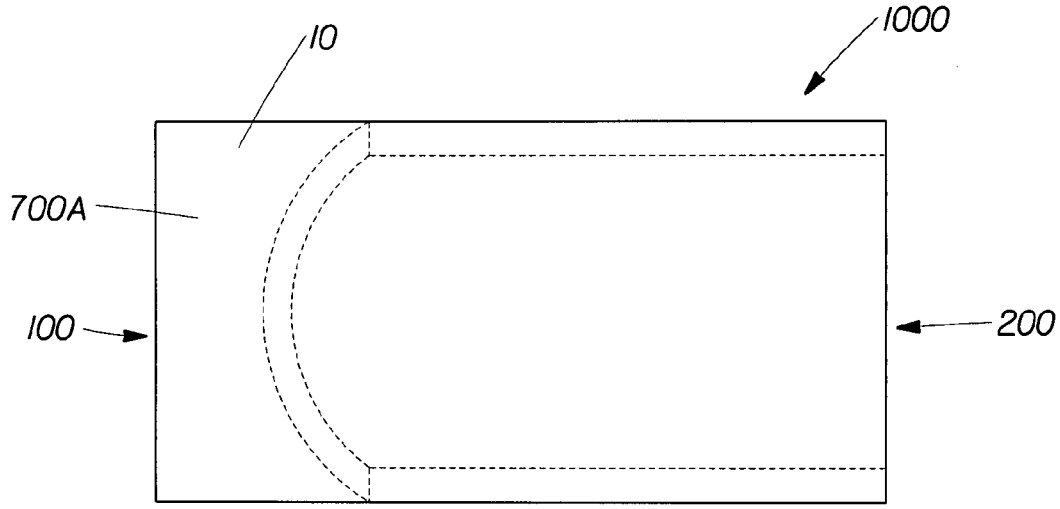
FIG. 8 is a plan view of an embodiment in which the package comprises overlapping first and second layers.
Figure 9:
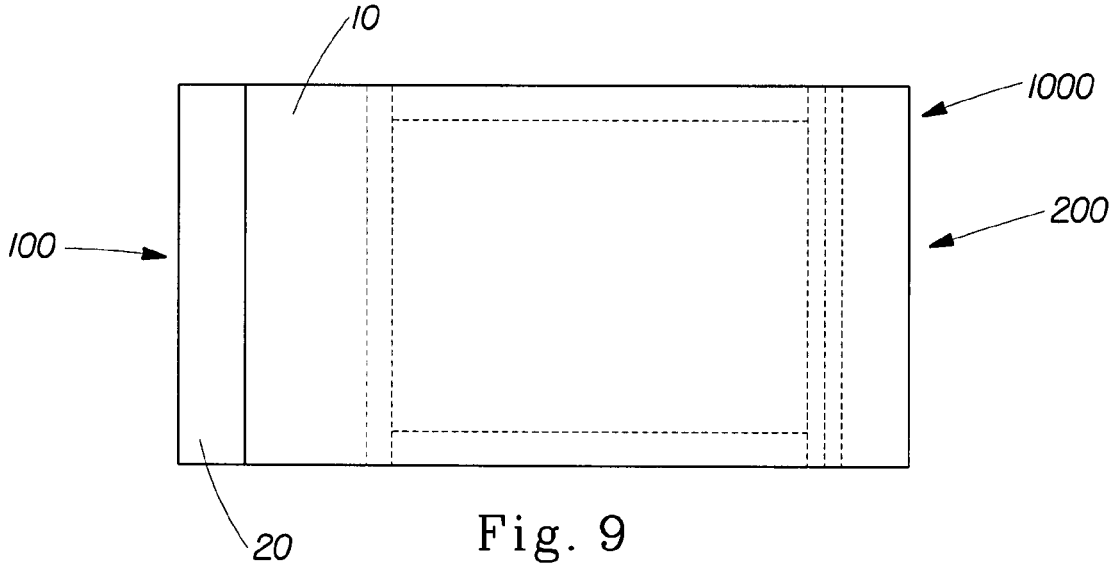
FIG. 9 is a plan view of an embodiment in which the package comprises first and second layers that do not overlap.
Figure 10:
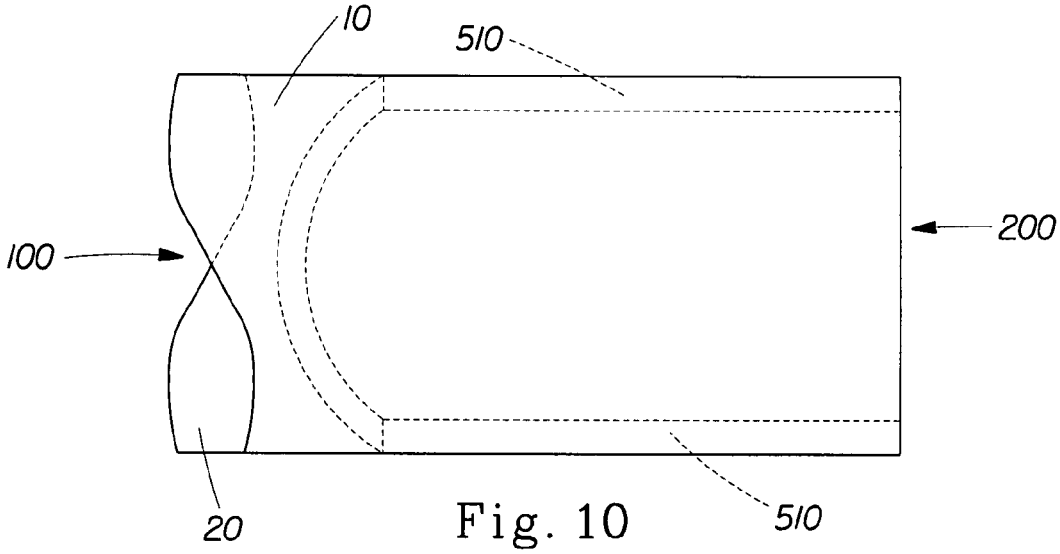
FIGS. 10-11, and 12A are plan views of embodiments in which the packages comprise different adhesive patterns.
Figure 11:
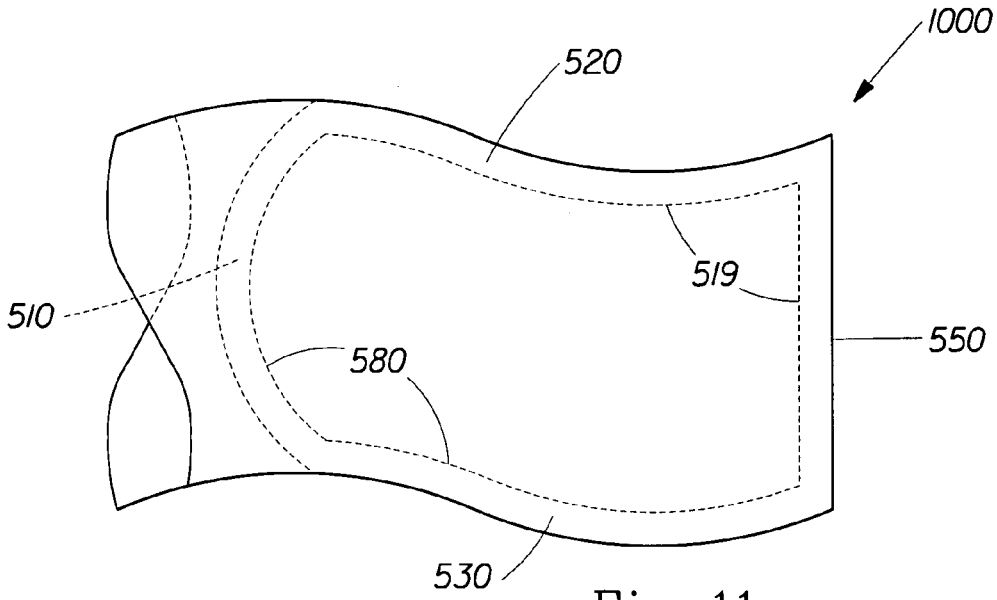
Figure 12A:
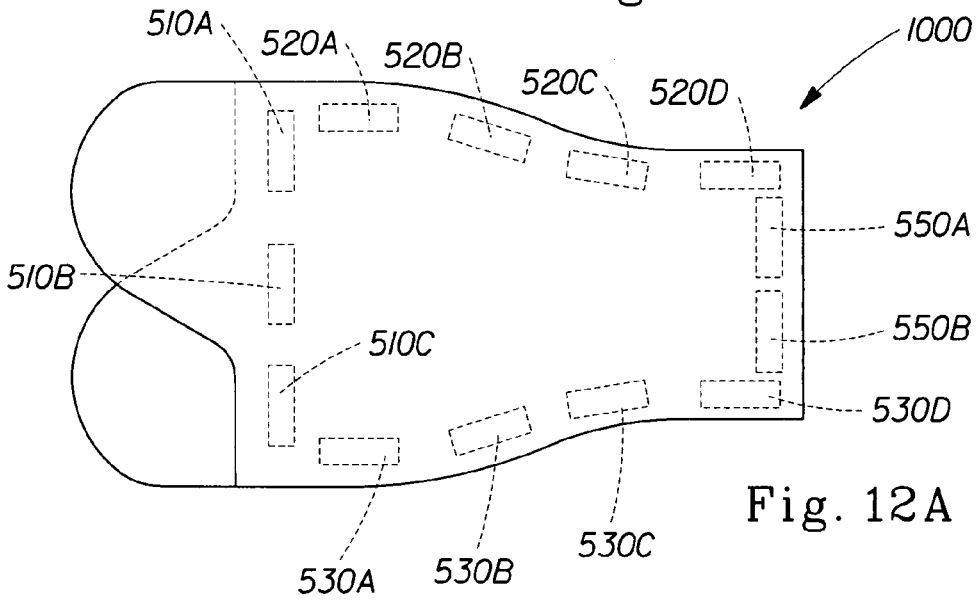
Figure 12B:
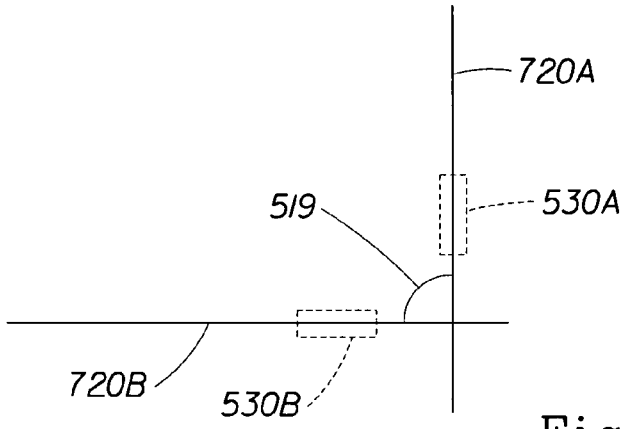
FIG. 12B shows the angular relation between two discrete seals.

Referring now to FIGS. 1-3, 5, 8 and 9, the packages 1000 of the present invention may take any suitable planar shape. The planar shape of the package 1000 may be determined by the planar shape of its first and second layers 10, 20, as well the layers' respective orientation when they are placed in a face to face relation and connected/removably attached. In some embodiments of the invention, the first and second layers are oriented such that when they are placed in a face to face relationship, they overlap. For example, FIG. 8 shows a plan view of one embodiment in which the package 1000 comprises two overlapping, rectangular first and second layers 10, 20 having the same size and shape (the second layer is not visible from this view). In other embodiments, the first and second layers are spatially staggered in a face to face relationship such that when they are connected/removably attached, they do not completely overlap. For example, FIG. 9 shows a plan view of one embodiment in which the package 1000 comprises rectangular first and second layers 10, 20 having the same size and shape that are connected/removably attached such that they do not overlap at the first end 100 of the resulting package 1000. In further embodiments, first and second layers having similar or identical shapes are placed in a face to face relationship with the second layer flipped in relation to the first layer. When the layers are connected/removably attached, they do not completely overlap at the first end of the resulting package. For example, FIGS. 1-3 and 5 show plan views of embodiments in which the first end 100 of the packages 1000 comprise first and second layers 10, 20 that do not completely overlap.

Referring now to FIGS. 1-5 and 10-12A, the first and second layers 10, 20 are removably attached in a face to face relationship by an adhesive pattern. The adhesive pattern may comprise: one seal with a variable peel strength, as shown for example in phantom in FIG. 10 as seal 510; a series of adjoining seals, as shown for example in phantom in FIG. 11 as seals: 510; 520; 530; and 550; or a series of discrete seals, as shown for example in phantom in FIG. 12A as seals: 510A-C; 520A-D; 530A-D; and 550 A and B. In some embodiments, a fourth seal is disposed such that it will intersect the cavity formed between the second and third seals, as shown for example in phantom in FIGS. 1-5 as seal 540. In embodiments in which the package comprises a first layer and a second layer that are made from two separate pieces of substrate (rather than a single piece of substrate folded onto itself), a fifth seal may connect the two layers together at the second end of the package, as shown for example in phantom in FIGS. 1 and 4 as seal 550.

Referring now to FIGS. 13-20, the packages of the present invention may be opened by peeling apart the first and second layers. To peel the layers apart, sufficient force is exerted to overcome the peel force of the seals removably attaching the layers together to form the package. Each seal is characterized by a peel force, which is constant or variable throughout the seal. Peel force is measured as described in the Methods section infra.

To provide for the controlled opening of the presently invented packages, adhesive patterns and the seals comprising them are chosen so as to regulate the amount of force necessary to peel the first and second layers of the packages apart, without ejecting any product(s) optionally contained therein from the package. For example, in the embodiment shown in FIG. 13, a single piece of substrate is folded onto itself forming the first and second layers 10, 20 of a package 1000, which are connected together at the second end 200 of the package by virtue of the resulting fold 560. The first and second layers 10, 20 are removably attached at the first end 100 of the package 1000 and along the first and second opposing longitudinal side edges 300A, 300B to the second end 200 of the package by an adhesive pattern. The adhesive pattern comprises 3 seals shown in phantom: a first seal 510 having a peel force "A" disposed proximate to the first end of the package 1000; a second seal 520 with a variable peel force that ranges from "$B_1$" to "$B_3$" disposed proximate to the first opposing longitudinal side edge 300A of the package; and a third seal 530 with a variable peel force that ranges from "$C_1$" to "$C_3$" disposed proximate to the second opposing longitudinal side edge 300B of the package.

Proximate to the first end 100 of the package 1000, the relative peel forces of the three seals may be represented by the formula:

$$A \approx B_1 + C_1$$

wherein: "+" represents "the sum of"; and $B_1$ is optionally about equal to $C_1$.

Moving from the first end 100 of the package 1000 toward the second end 200 of the package, the peel forces of $B_1$ and $C_1$ respectively increase to $B_2$ and $C_2$ such that the relative peel forces are now represented by the formula:

$$A < B_2 + C_2$$

wherein: "+" represents "the sum of"; and $B_2$ is optionally about equal to $C_2$.

Approaching the second end 200 of the package 1000, the peel forces of $B_2$ and $C_2$ respectively increase further to $B_3$ and $C_3$, such that the relative peel forces are now represented by the formula:

$$A << B_3 + C_3$$

wherein: "+" represents "the sum of"; and $B_3$ is optionally about equal to $C_3$.

Figure 14:
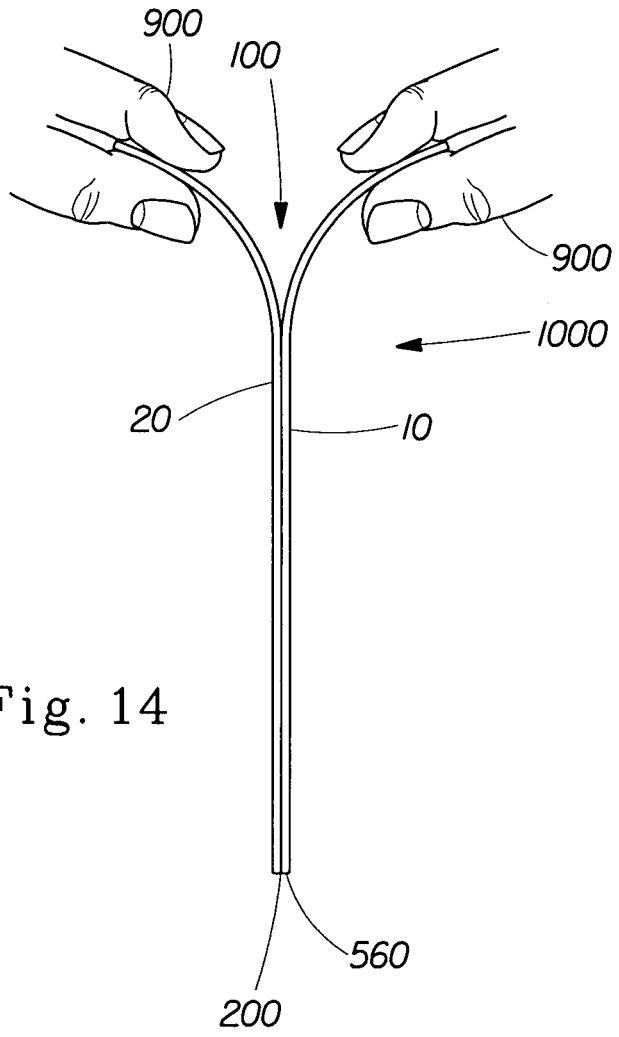
Figure 15:
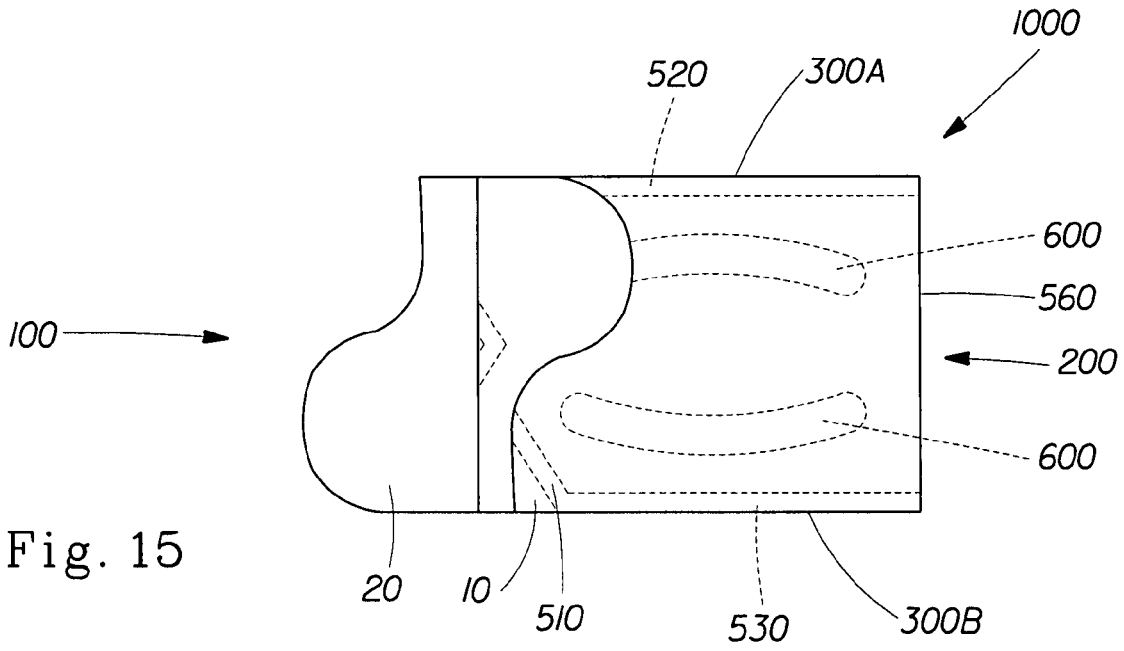
Figure 16:
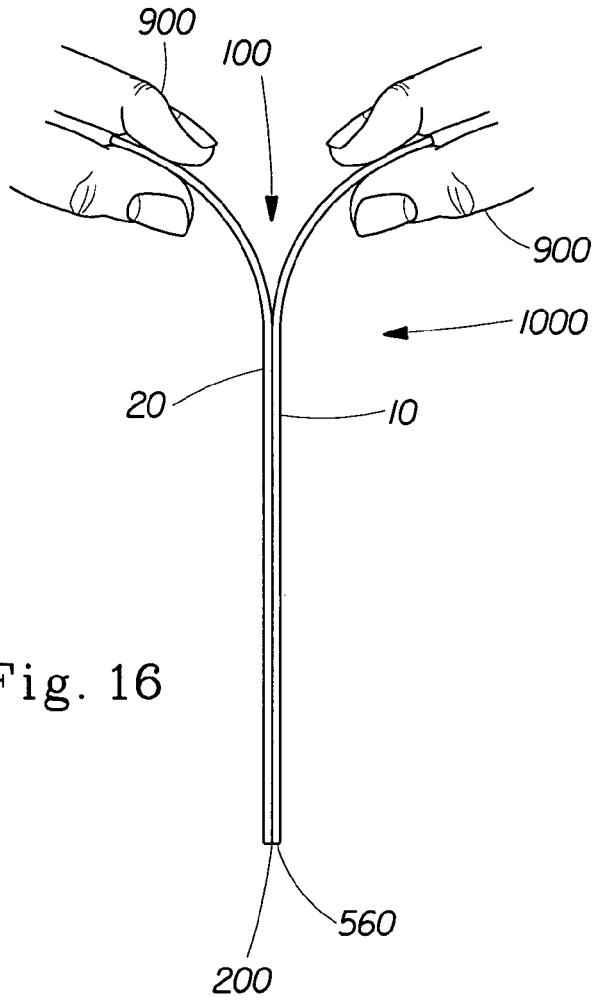

In this embodiment, the peeling apart of the first and second layers 10, 20 of the package 1000 may be initiated by gripping each layer at the first end 100 of the package between the fingers 900 as shown in plan view in FIG. 13, and from a side view in FIG. 14. A first pulling force "$F_1$" that is greater than A and $B_1$+C, is exerted such that the first seal 510 disposed proximate to the first end 100 of the package 1000, and portions of the second and third seals 520, 530 disposed proximate to the first end of the package 1000, "fail". The seals, 510, 520, 530, fail in that the portions of the first and second layers 10, 20 that had been fastened together by the seals are allowed to separate as shown in plan view in FIG. 15 and from a side view in FIG. 16.

Figure 17:
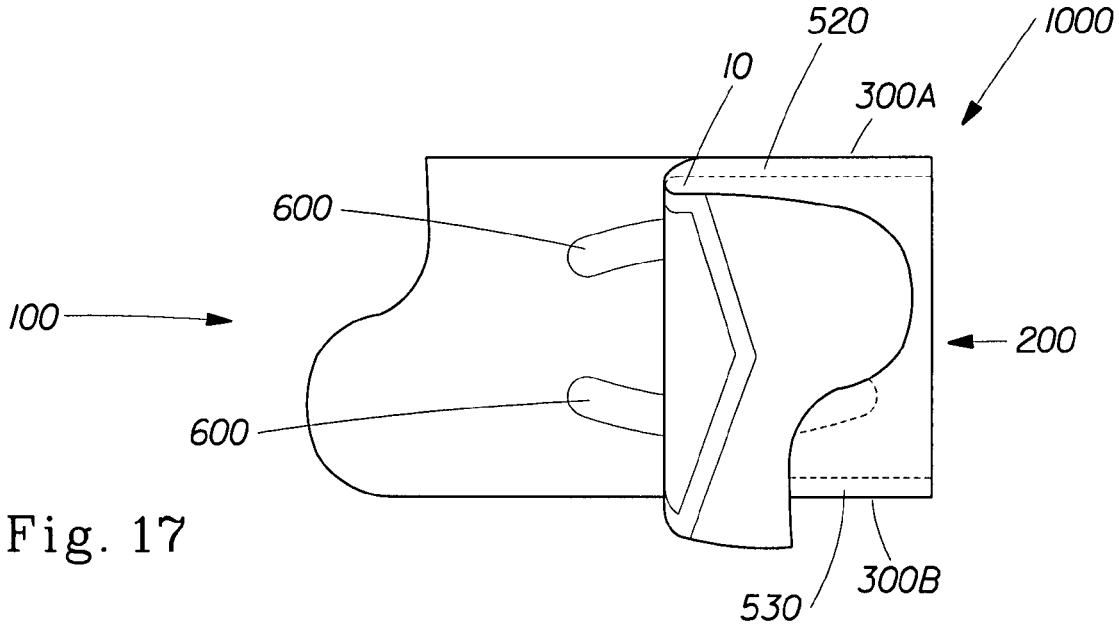
Figure 18:
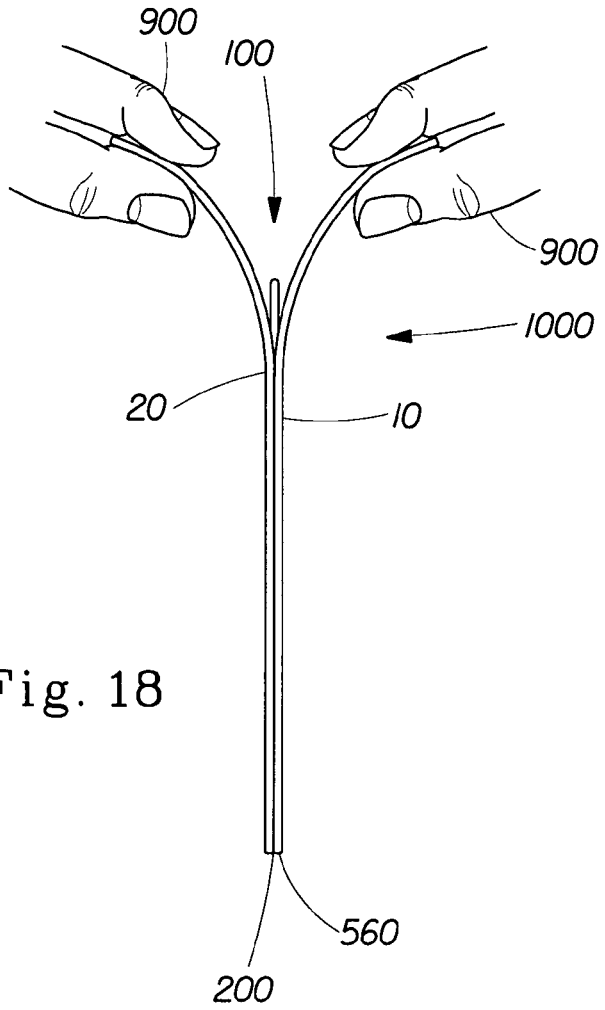
Figure 19:
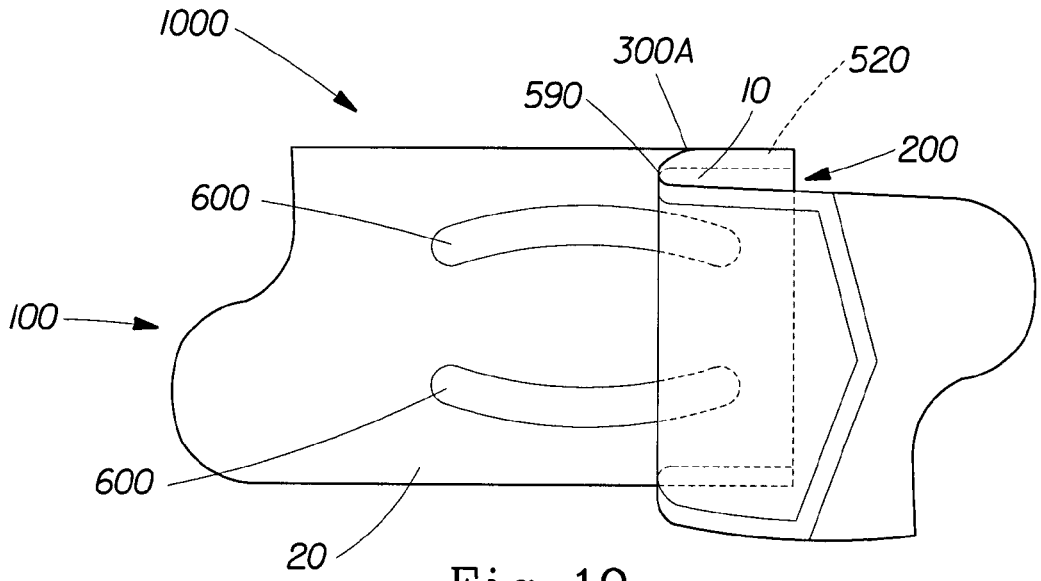
Figure 20:
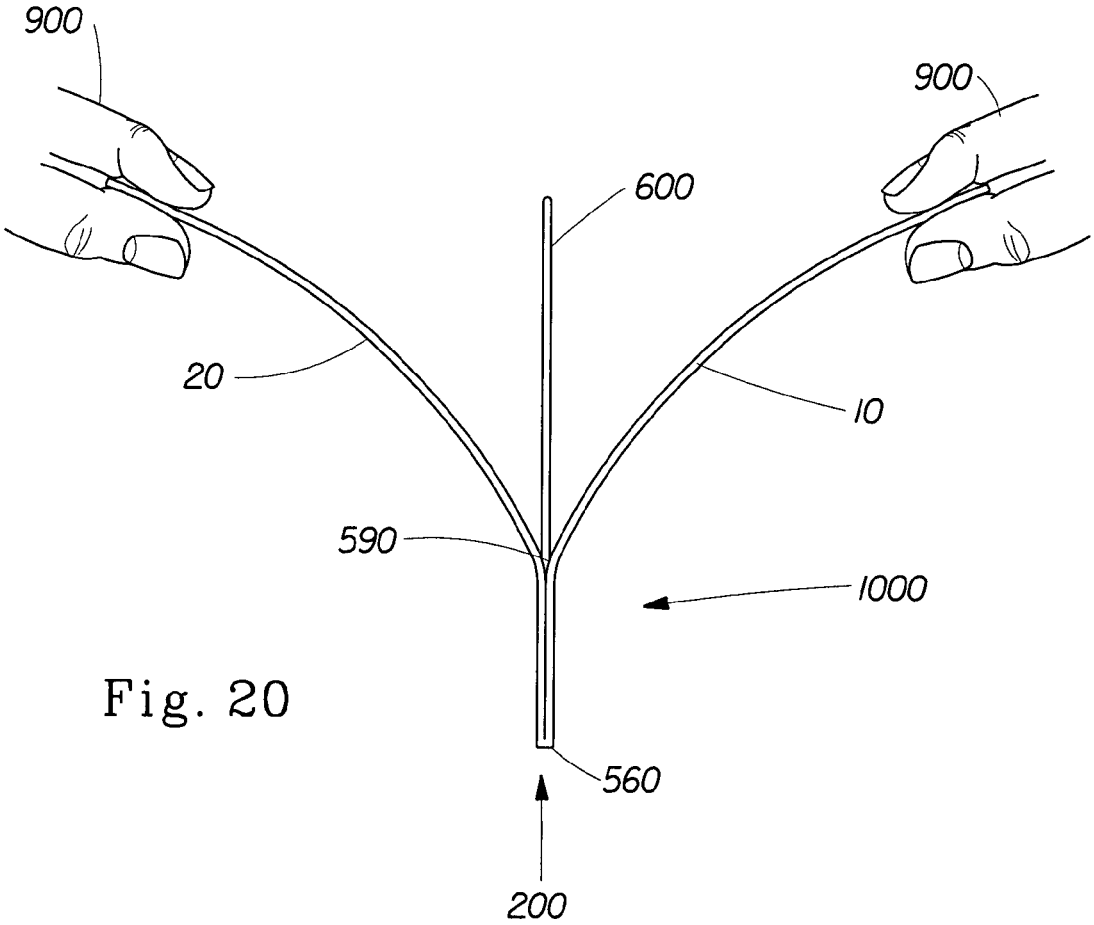

To further peel apart the layers, a second pulling force "$F_2$" that is greater than $B_2$+$C_2$, is exerted such that the portions of the second and third seals 520, 530 with these peel forces fail as shown in plan view in FIG. 17, and from a side view in FIG. 18.

The peel forces $B_3$ and $C_3$ are chosen such that a pulling force in great excess to that of $F_2$ would be necessary to cause those portions of the second and third seals 520, 530 with these peel forces to fail. Thus the separation of the first and second layers 10, 20 is checked at a point at which the peel forces are about equal to $B_3$+$C_3$. Optional products 600 are still partially contained by the unopened portion of the package 1000 and are presented for removal as shown in plan view in FIG. 19, and from a side view in FIG. 20.

One of skill in the art is able to achieve the separation of the two layers and provide for presentation and removal of any product(s) optionally contained therein by choosing any suitable combination of adhesive patterns of seals, and their relative peel forces. In the embodiments shown in FIGS. 13-20, a first seal 510 is disposed proximate to the first end 100 of the package 1000 and second and third seals 520, 530 are respectively disposed proximate to the first and second opposing longitudinal side edges 300A, 300B of the package. The peel forces of the portions of the second and third seals 520, 530 disposed proximate to the first end 100 of the package 1000, are about equal to the peel force of the first seal 510. Moving from the first end 100 of the package 1000 toward its second end 200, the peel forces of the second and third seals 520, 530 increase incrementally (from $B_1$,$C_1$ to $B_2$,$C_2$ to $B_3$,$C_3$). Alternatively, in some embodiments the increase in the peel strength of the second seal and third seal is continuous over the length of the seal(s). Alternatively, in some embodiments the increase in peel strength of the second seal and third seal is a combination of continuous and incremental over the length of the seal(s). Alternatively, in some embodiments the peel strength of only one of the second and third seals is variable over the length of the seal, either incrementally, continuously or combinations thereof. In some embodiments, the peel force of the first seal may be greater than the peel force of the portions of the second and/or third seals disposed proximate to the first end of the package. In these embodiments, a stronger first seal may prevent accidental or premature opening of the package. In embodiments in which a fifth seal connects two separate pieces of substrate together, the peel force of the fifth seal may also be appropriately chosen such that excessive force would be necessary to break it.

The point at which the peel force of a seal increases such that excessive force is required to separate the first and second layers of a package is referred to herein as the "stopping point". At the stopping point, at least a portion of the product (s) optionally contained in the package is exposed for removal therefrom. For example, the stopping point 590 of one embodiment is shown in plan view in FIG. 19 and from a side view in FIG. 20.

The amount of force required to peel apart the layers of a package may be affected by the geometry of the seal(s), and if there is more than one seal, their relative placement. The relative placement of the portions of a single seal, and/or the relative placement of more than one seal, may be described by their "angular relation", meaning the angle at which they intersect in a given plane. In the embodiment shown in FIG. 11, the angular relation between the first and third seals 510, 530 is described by the angle 580. If the seals do not intersect (as in the case of discrete seals), a straight line may be drawn through each seal, and their angular relation is described by the angle at which the lines ultimately intersect in a given plane. In the embodiment shown in FIG. 12B (which is an expanded view of two of the discrete seals of the embodiment shown in FIG. 12A), a straight line 720A is drawn through seal 550A and a straight line 720B is draw through 530D. The angular relation between the seals 550A and 530D is described by the angle 519 at which the lines 720 A and 720B intersect.

Portions of a single seal and/or more than one seal may be arranged such that they have any suitable angular relation. Angular relations may be defined by obtuse angles, acute angles, right angles or combinations thereof. For example, in the embodiment shown in FIG. 13, the desired peel force of the first seal 510 is achieved by making it chevron-shaped such that it may be described by the angle 511 of about 120°. The first seal 510 adjoins each of the second and third seals 520, 530 such that their relative placement is described by the obtuse angles 515.

Seals may be made using any suitable means. Non-limiting examples of sealing means include mechanical sealing and chemical sealing. Without wishing to be bound by theory, mechanical sealing is believed to involve topographical interference between the layers to be sealed. Non-limiting examples of mechanical sealing include crimping, stamping, interlocking mechanisms and combinations thereof. Interlocking mechanisms may comprise any interlocking shape. Non-limiting examples of interlocking mechanisms include protruding tabs, interlocking tabs, interlocking slots, hook and eye-type systems and combinations thereof. Without wishing to be bound by theory, chemical sealing is believed to involve chemical interaction between the layers. Non-limiting examples of chemical means of sealing include the use of: heat sealing; induction sealing; sonic welding; pressure welding; hot melt adhesives; solvent adhesives; solvent welding; glues; resins; rosins; cross-linking agents; and combinations thereof.

In embodiments in which the layers of a package comprise thermoplastic materials, heat sealing may be achieved by melting a material or mixture of materials between the layers. The material or mixture of materials may have a melt temperature lower than that of the thermoplastic materials comprising the layers to avoid compromising the integrity of the layers by melting them during the sealing process.

The packages of the present invention may optionally comprise grip tabs at the first end of the package. Grip tabs may aid in the opening of a package by providing appendages with which to grip each of its first and second layers. The packages of the present invention may comprise grip tabs that are the same or different.

Figure 21:
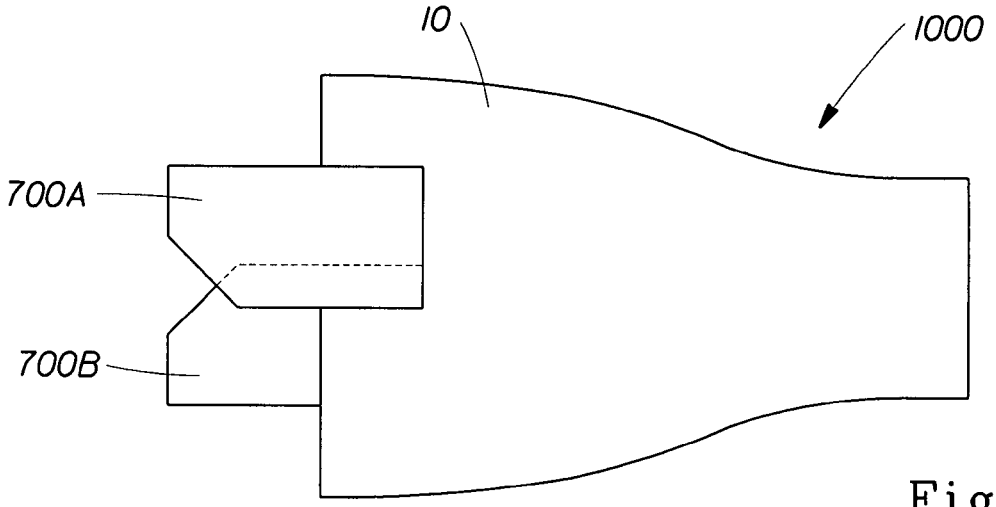
FIGS. 21-23 are plan views of embodiments in which the packages comprise grip tabs.
Figure 22:
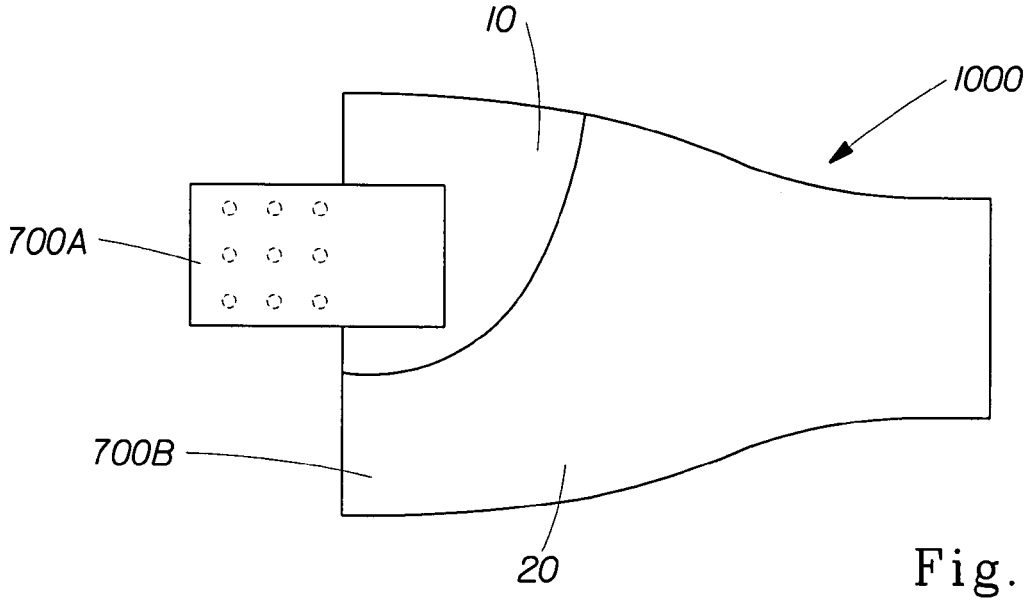

Grip tabs are provided using any suitable means. In some embodiments of the present invention, the grip tabs comprise unattached portions of the first and second layers at the first end of the packages. For example, in the embodiments shown in FIGS. 1-5, grip tabs 700A and 700B respectively comprise the unattached portions of the first and second layers 10, 20 at the first end 100 of the packages 1000. In some embodiments, grip tabs are provided by attaching separate substrates by any suitable means to both the first and second layers of the package. For example, in the embodiment shown in FIG. 21, the grip tabs 700A and 700B are respectively attached to the first layer 10 and second layer (not visible from this view). In further embodiments, a grip tab comprising an unattached portion of a first or second layer and a grip tab comprising a separate substrate attached to the other layer are provided. For example, in the embodiment shown in FIG. 22, the grip tab 700A is a separate substrate attached to the first layer 10, and the grip tab 700B is an unattached portion of the second layer 20.

Figure 23:
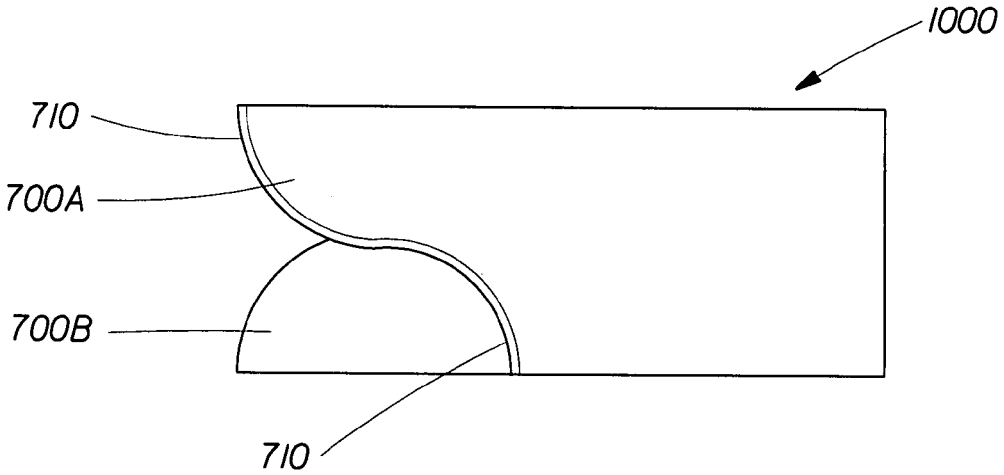

Grip tabs may have any suitable shape. The shape of a grip tab may be described by a line traced along the edges of the tab that are not connected to the package; the line is referred to herein as the "edge line". Referring to FIG. 23, the tab 700A has an edge line 710. Grip tabs of use in the present invention may have edge lines selected from the group consisting of curvilinear lines, linear lines or combinations thereof.

Grip tabs may comprise texture. If texture is not already present on the substrates comprising the grip tabs, it may be added using any means known in the art including, but not limited to, coating. Any suitable type of texture is of use in the present invention including, but not limited to, bumps, ridges, knurls, indentations, punctures or combinations thereof. Non-limiting examples of grip tabs with texture are shown as: grip tab 700A in FIG. 1; grip tab 700A in FIG. 5; and grip tab 700A in FIG. 22. Texture may help to prevent fingers from slipping from the grip tabs, particularly in moist environments such as bathrooms and kitchens. Texture may additionally or alternatively, provide a tactile means of determining from which end the package is designed to be opened, and/or may aid in distinguishing between the grip tabs. In this way, texture can aid the vision impaired in opening the packages of the present invention.

Grip tabs may have any suitable appearance. Grip tabs may comprise any color or patterns of color. Grip tabs may be opaque, translucent, transparent or combinations thereof. The grip tabs comprising the packages of the present invention may be the same or different in appearance. Grip tabs that differ in appearance may aid in distinguishing between the grip tabs, particularly for the vision impaired who would otherwise have a difficult time seeing where the tabs can be separated from each another.

Grip tabs may or may not overlap each other. Grip tabs can overlap as shown for example in plan view in FIG. 8, in which only one tab, 700A is visible. Non-limiting examples of grip tabs that do not overlap are shown in FIGS. 1-5 and 21-23. Non-overlapping grip tabs may aid in distinguishing between the grip tabs. Non-overlapping grip tabs may also aid in the gripping of each tab, particularly for those who have limited manual dexterity (such as individuals with arthritis).

The packages of the present invention are designed such that they may contain products. Non-limiting examples of products that may be contained in the present packages include: compositions, creams, formulations, towelettes, toothpicks, powders, adhesives, medicaments, and the like.

In some embodiments of the present invention, oral care substances, dentifrices and/or oral care devices are contained within the packages. Any oral care device suitable for enclosure in the present packages is of use. Non-limiting examples of suitable oral care devices include toothbrushes, mouth rinses, floss, teeth whitening strips such as Crest™ Whitestrips™ (manufactured by the Procter & Gamble Company, Cincinnati, Ohio), and the like. Any oral care substance or dentifrice suitable for enclosure in the packages of the present invention may be of use. Non-limiting examples of suitable oral care substances may provide denture and/or tooth whitening, denture and/or tooth cleaning, and the like. A number of suitable oral care compositions are disclosed in U.S. Pat. Nos. 5,891,453, 5,879,691, 6,730,316, 6,277,458, 6,045,811, 5,989,569, 6,884,426, and U.S. patent application Ser. Nos. 10/715,003, 10/870,293, 11/455,469 and 60/831356.

In some embodiments of the present invention, the oral care substance may be a denture adhesive. Suitable denture adhesives may take any form that can be contained in the packages of the present invention. Non-limiting examples of suitable denture adhesive include creams, pastes, gels, liquids, strips, wafers or combinations thereof. A number of suitable denture adhesives are disclosed in U.S. patent application Ser. Nos. 11/590,224, 11/590,233, 11/590,111, 11/590,225, 11/590,191, 11/590,231 and 11/590,232 .

The packages of the present invention may contain a denture adhesive strip or strips. Referring now to the embodiments shown in FIGS. 1-5, denture adhesive strips 600 are shown in phantom within the cavities 30 of the packages 1000. In embodiments in which the denture adhesive strip 600 is sensitive to moisture, the first and second layers 10, 20 forming the package 1000 may be removably attached by an adhesive pattern comprising water tight seal(s) 510, 520, 530, (and in some embodiments) 550, which are located along unconnected portions of the package.

Figure 2:
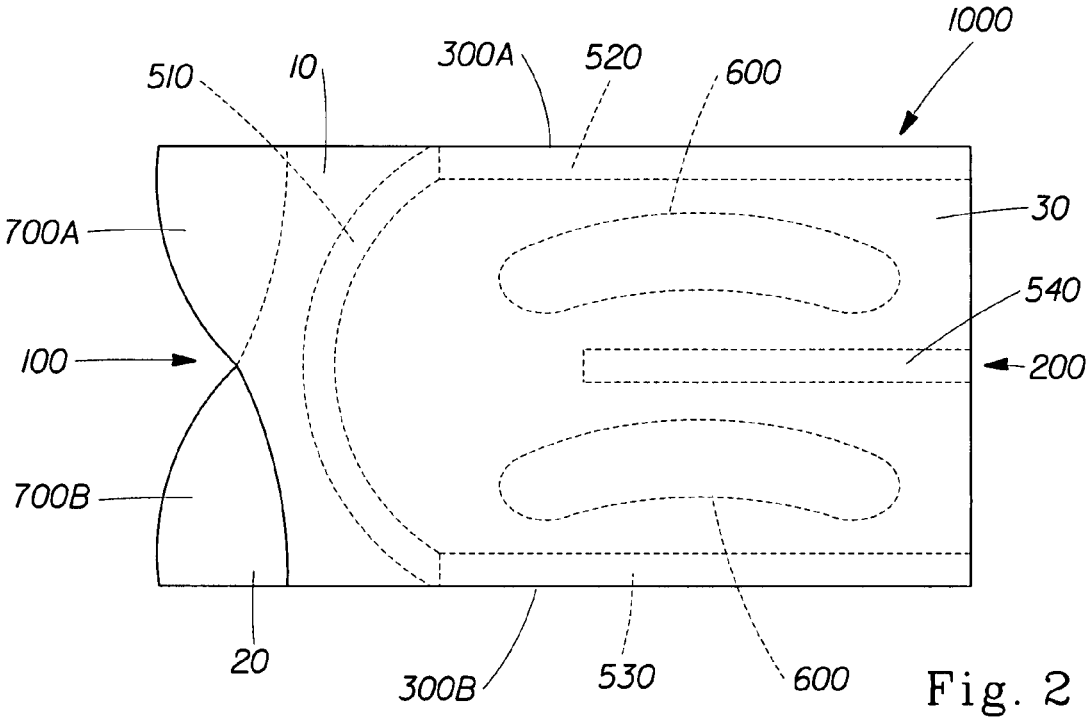
Figure 3:
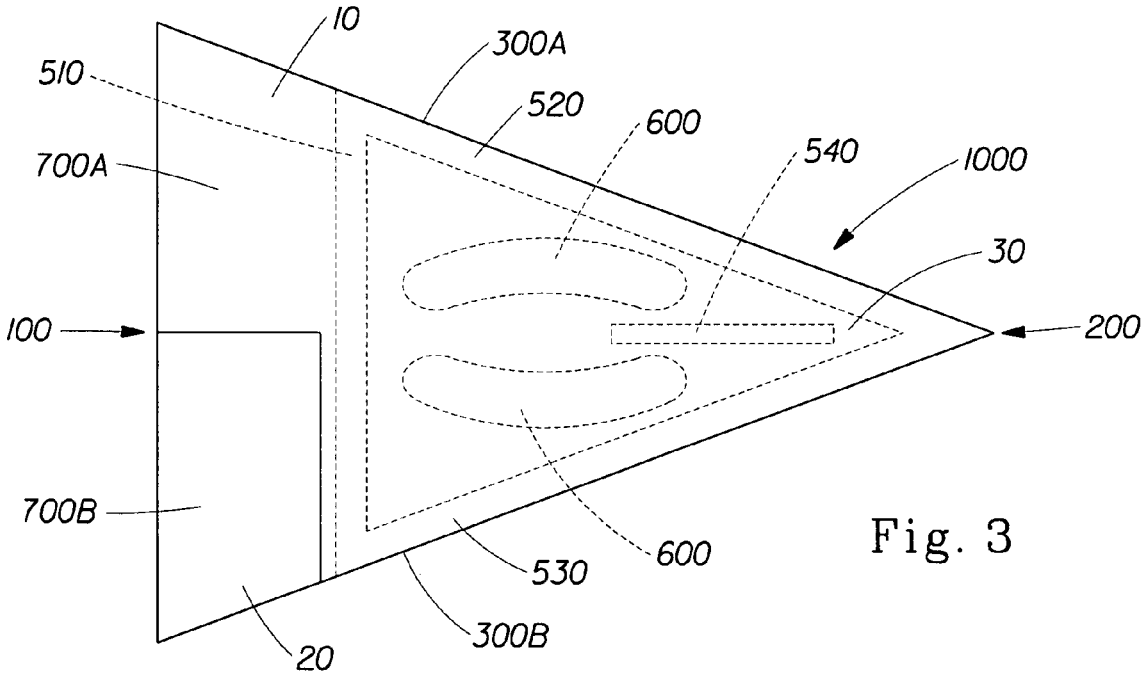
Figure 4:
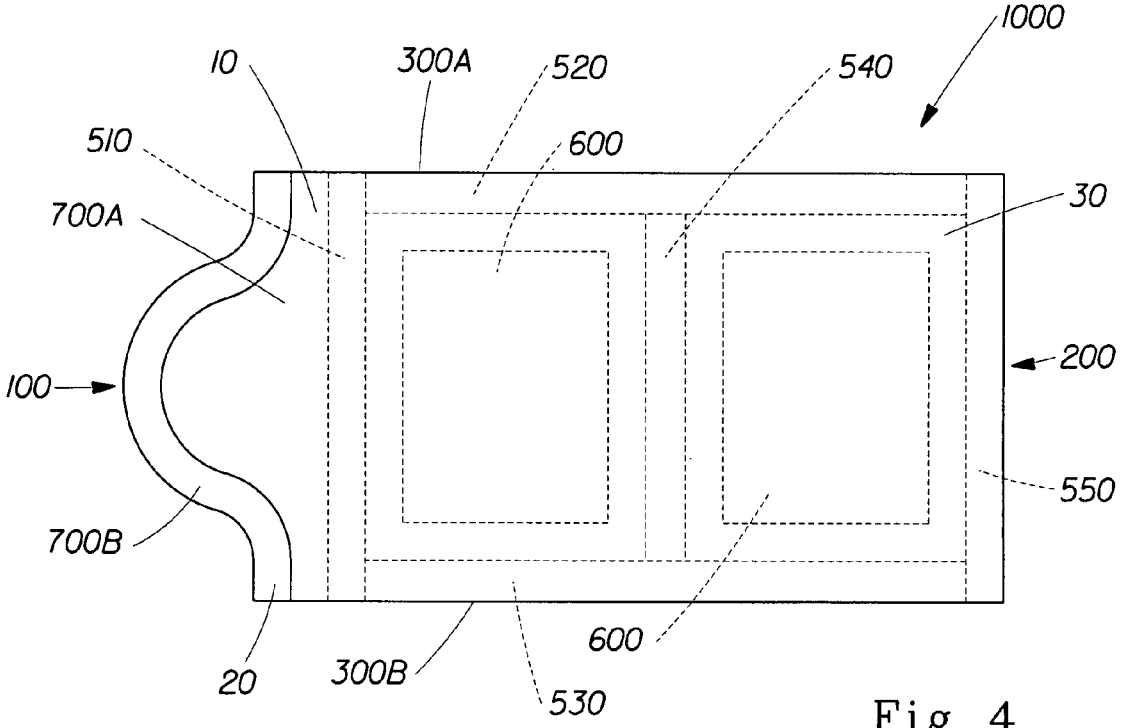
Figure 5:
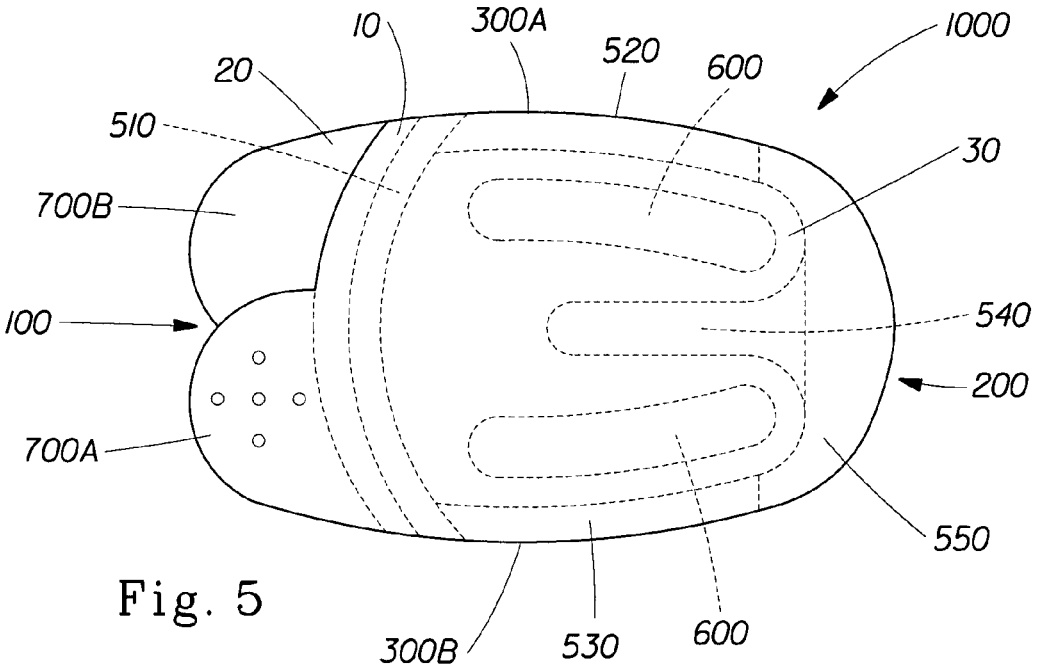

In embodiments in which the package contains more than one denture adhesive strip, any suitable means of keeping the strips separated may be used. One non-limiting example of a separating means is the use of a fourth seal 540 as shown in FIGS. 1-4. The fourth seal 540 may comprise a discrete seal as shown in FIGS. 2 and 3, or it may adjoin another seal as shown in FIGS. 1 and 5. The peel strength of the fourth seal may be chosen by one of skill in the art to provide for the controlled opening of the present packages.

Figure 24:
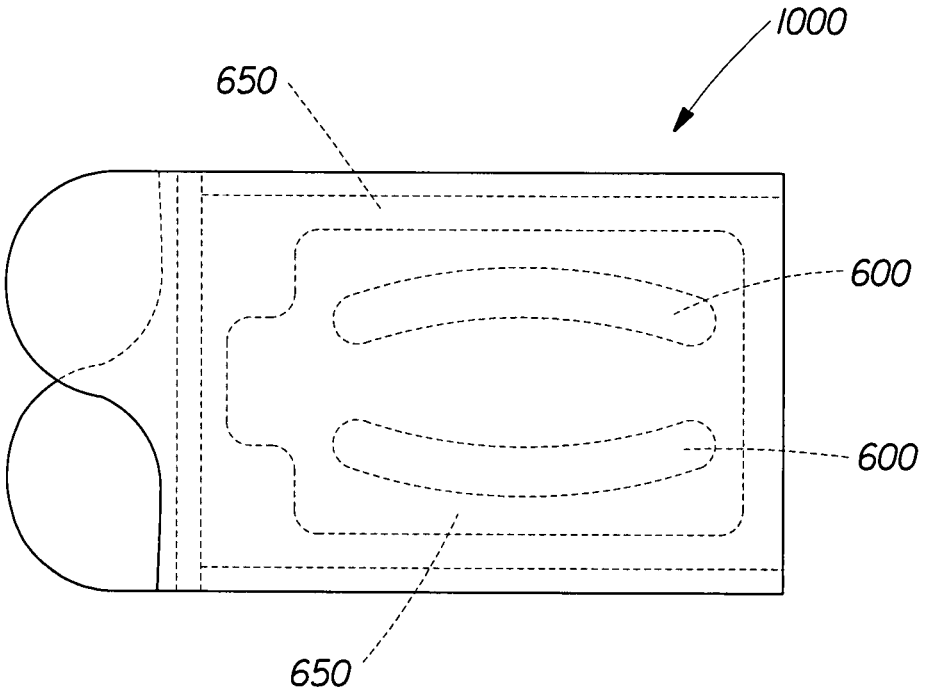
FIG. 24 is a plan view of one embodiment in which adhesive strips are adhered to a plastic tray located in the cavity of the package.

In some embodiments, the denture adhesive strip(s) may be removably adhered to a tray. FIG. 24 shows an embodiment in which denture adhesive strips 600 are removably adhered to a plastic tray 650, which is sealed in the cavity 30 of the package 1000. When the package 1000 is peeled opened, the tray 650 may be removed for access to the denture adhesive strip (s) 600.

Referring now to FIGS. 25-28, a plurality of the packages of the present invention may comprise "primary" packages 1000 that are contained within a larger "secondary" package 2000. Containment of a plurality of primary packages within a secondary package may provide convenience in the shipping, stocking on store shelves, use (individual or otherwise) and portability of the products contained within the primary packages.

Any suitable secondary package may be of use. Non-limiting examples of secondary packages include boxes, cartons, pouches, compacts, and the like. The secondary packages may be made of any suitable material. Non-limiting examples of materials include plastics, paper products, and the like.

Figure 25:
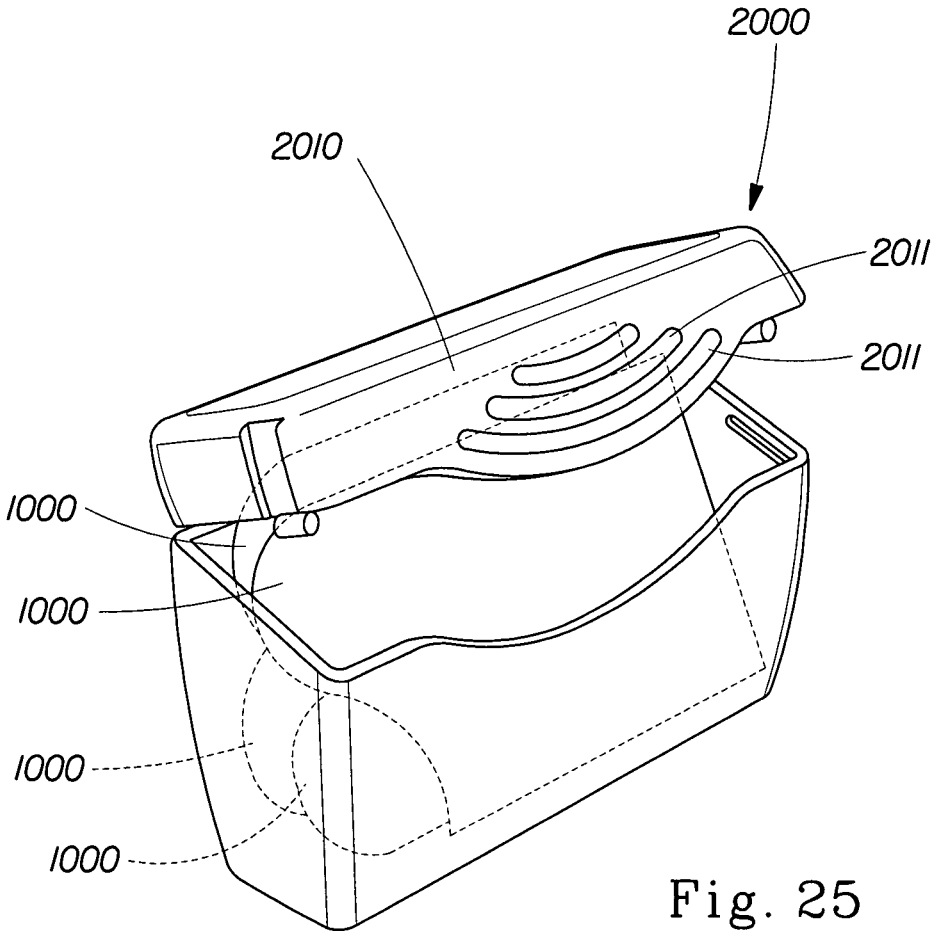
FIGS. 25-28 show embodiments of secondary packages of the present invention.

In one embodiment, a plurality of primary packages 1000 is contained in a secondary package 2000 comprising clear plastic as shown in FIG. 25. The secondary package 2000 is of one-piece construction with a hinged lid 2010, which has texture 2011 so as to make opening of the package easier, particularly in moist environments. Advantageously, the secondary package 2000 is also clear so it may easily be seen how many primary packages 1000 are contained within the secondary package.

Figure 26:
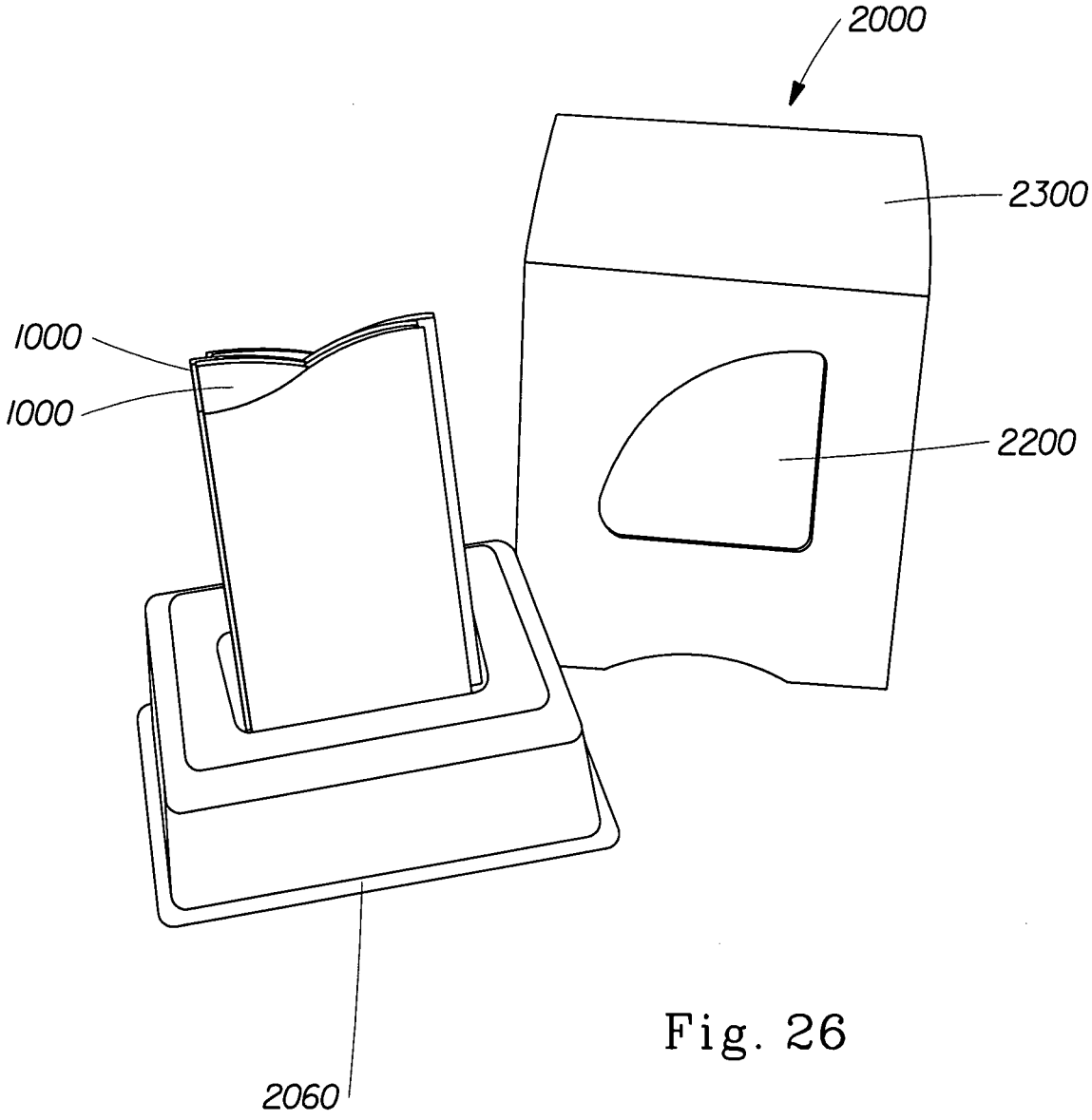

In another embodiment, the secondary package comprises plastic and cardboard as shown in FIG. 26. The bottom of the secondary package 2000 comprises a plastic trough 2060 in which the primary packages 1000 are placed. The top 2300 of the secondary package 2000 comprises a cardboard box which may be slipped on and off of the trough 2060. The secondary package 2000 optionally has a clear plastic window 2200 through which it may easily be determined how many primary packages 1000 are contained therein.

Figure 27:
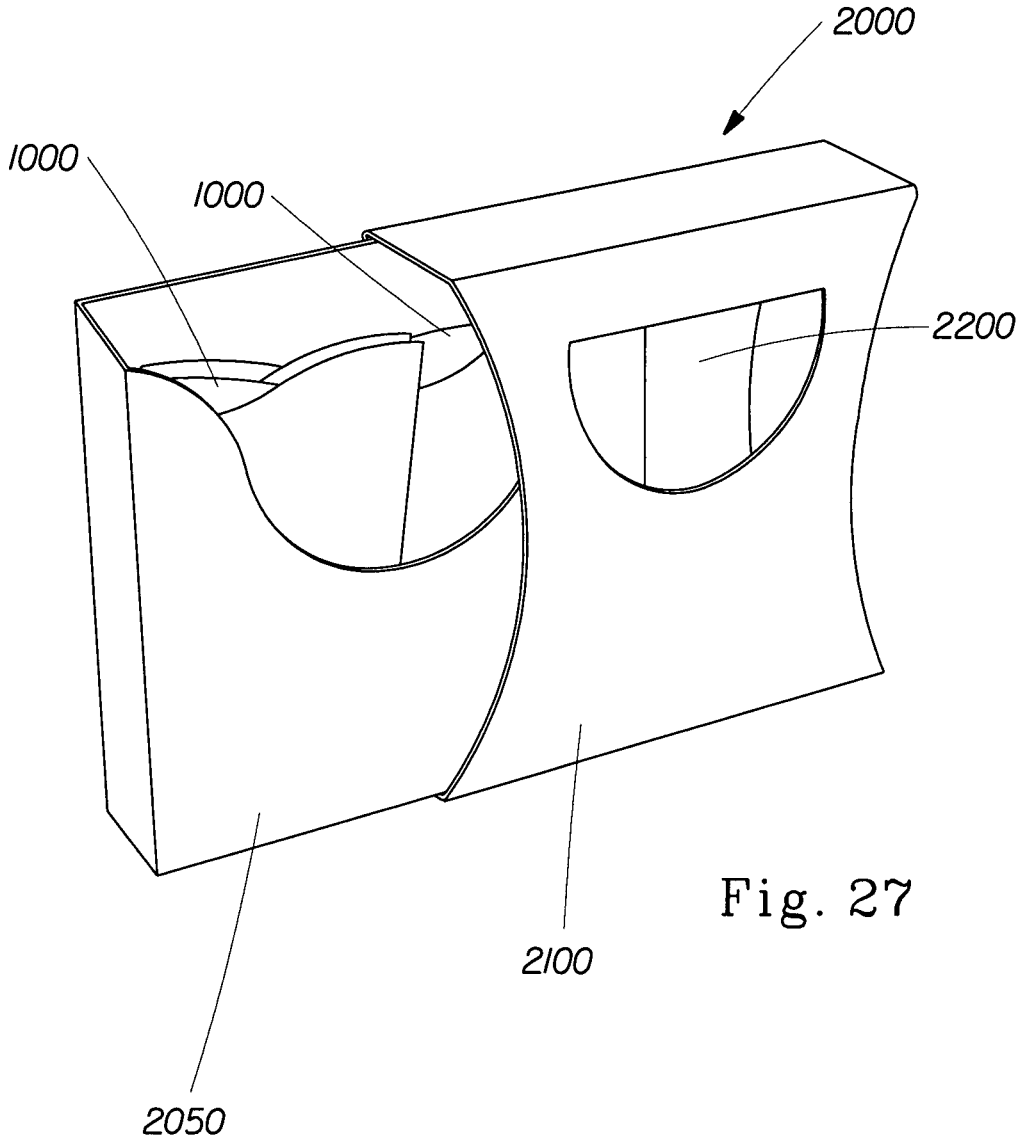

In another embodiment, the secondary package 2000 comprises cardboard as shown in FIG. 27. The primary packages 1000 are held in a first box 2050, which is slipped into a sleeve 2100. The sleeve 2100 optionally has a cut-out window 2200 through which it may easily be determined how many primary packages 1000 are contained therein.

Figure 28:
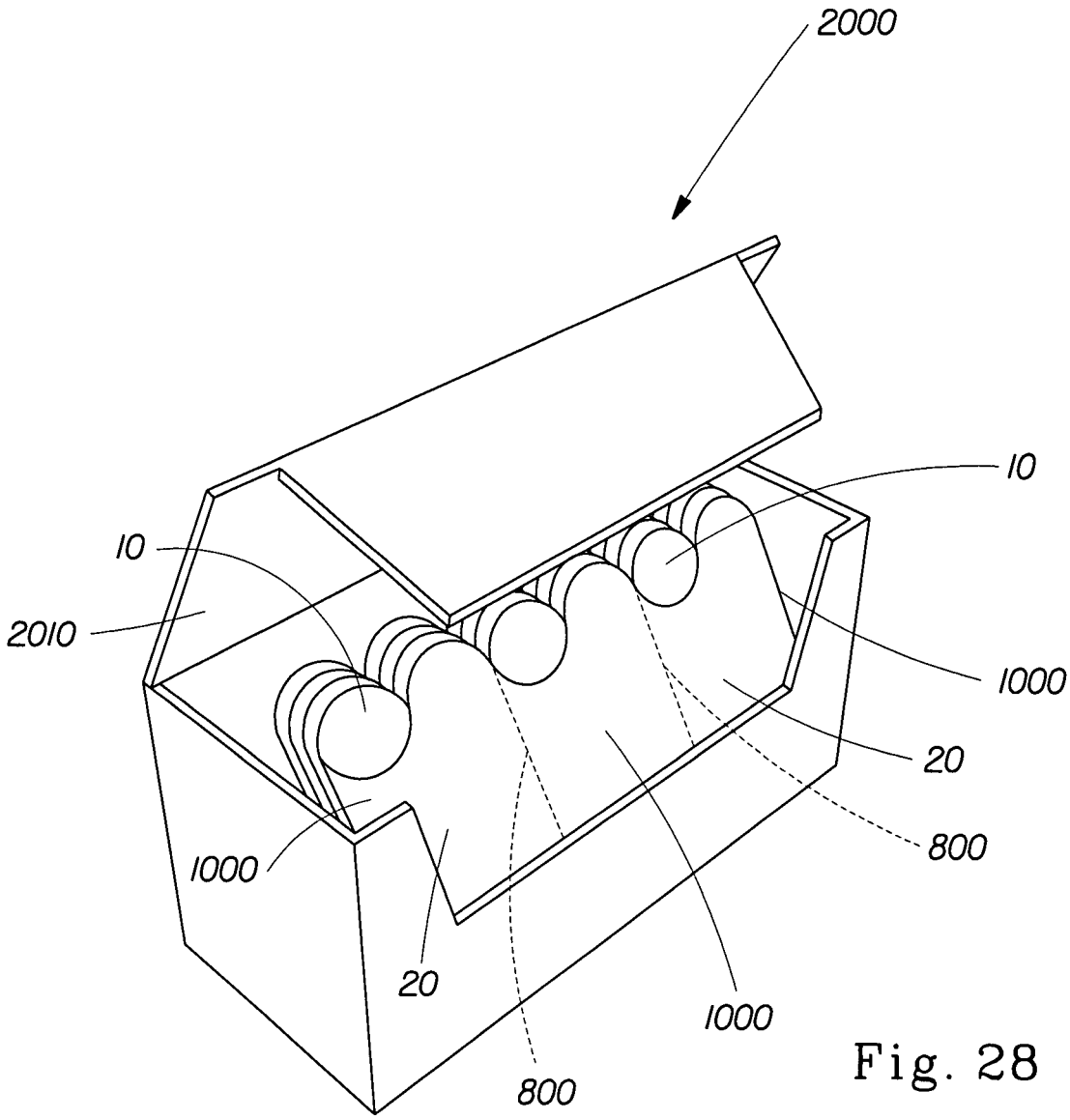

In another embodiment, a plurality of primary packages 1000 is "linked" together as shown in FIG. 28. The primary packages 1000 are linked as a result of being made from two large pieces of substrate layers, 10 and 20, that are removably connected/removably attached. Lines of weakness 800, shown here as perforations, make the primary packages 1000 easily separable. These primary packages 1000 are contained in a secondary package 2000 shown in the open position, comprising a one-piece cardboard box with a hinged lid 2010.

Methods

Peel force is measured according to ASTM Test Number F 88-06 using a Model Number 5500R tensile tester from Instron Corp. (Norwood, Mass., USA).

The dimensions and values disclosed herein are to be understood as not being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package comprising:

(a) a first end;

(b) a second end distal from said first end; and (c) first and second opposing longitudinal side edges extending between said first and second ends;

said package further comprising a first layer and a second layer connected at said second end, said first and second layers being removably attached in a face to face relationship by an adhesive pattern defining a cavity between said first and second layers, wherein said cavity contains at least one denture adhesive strip, said adhesive pattern comprising:

i. a first seal disposed proximate to said first end;

ii. a second seal disposed proximate to said first opposing longitudinal side edge; and iii. a third seal disposed proximate to said second opposing longitudinal side edge;

wherein at least one of said second and third seals has a variable peel force that increases between said first and second ends of said package.

2. The package of claim 1, wherein said variable peel force increases between said first and second ends of said package incrementally, continuously or combinations thereof.

3. The package of claim 2, wherein at least one of said seals having a variable peel force comprises a stopping point, wherein said variable peel force of said seal is lower between said first end of said package and said stopping point than it is between said stopping point and said second end of said package.

4. The package of claim 1, wherein said adhesive pattern further comprises a fourth seal intersecting said cavity between said second and third seals.

5. The package of claim 1, wherein said first and second layers comprise a single substrate folded at said second end.

6. The package of claim 1, wherein said first and second layers respectively comprise first and second substrates connected at said second end by a fifth seal.

7. The package of claim 1, further comprising grip tabs with edge lines wherein said grip tabs are formed by said first and second layers.

8. The package of claim 7, wherein said edge lines are selected from the group consisting of curvilinear lines, linear lines or combinations thereof

9. The package of claim 7, wherein said grip tabs do not overlap each other.

10. The package of claim 7, wherein at least one of said grip tabs further comprises texture.

11. The package of claim 7, wherein each of said grip tabs is opaque, translucent, transparent or combinations thereof.

12. The package of claim 7, wherein said grip tabs comprise colors that are different from each other.

13. The package of claim 3, wherein said first and second layers comprise substrates selected from the group consisting of foil laminates, metalized films, clear plastics or combinations thereof.

14. The package of claim 13, wherein said cavity is impervious to moisture exterior to said package.

15. The package of claim 14 , such that when said first and second layers are peeled apart to said stopping point, at least a portion of said denture adhesive is exposed for removal from said package.

16. The package of claim 1, wherein the angular relation between the first seal and at least one other seal is obtuse.

17. The package of claim 1, wherein the package comprises two denture adhesive strips.

18. The package of claim 17, wherein the package further comprises a fourth seal disposed between the two denture adhesive strips.

19. A secondary package containing a plurality of primary packages, said primary packages comprising:

(a) a first end;

(b) a second end distal from said first end; and (c) first and second opposing longitudinal side edges extending between said first and second ends;

said primary packages further comprising a first layer and a second layer connected at said second end, said first and second layers being removably attached in a face to face relationship by an adhesive pattern defining a cavity between said first and second layers, wherein said cavity contains at least one denture adhesive strip, said adhesive pattern comprising:

i. a first seal disposed proximate to said first end;

ii. a second seal disposed proximate to said first opposing longitudinal side edge; and iii. a third seal disposed proximate to said second opposing longitudinal side edge;

wherein at least one of said second and third seals has a variable peel force that increases between said first and second ends of said primary packages.

20. The secondary package containing a plurality of primary packages of claim 19, said primary packages further comprising grip tabs formed by said first and second layers.

21. A package comprising:

(a) a first end;

(b) a second end distal from said first end; and (c) first and second opposing longitudinal side edges extending between said first and second ends;

said package further comprising a first layer and a second layer connected at said second end, said first and second layers being removably attached in a face to face relationship by an adhesive pattern defining a cavity between said first and second layers, wherein said cavity contains at least one denture adhesive strip, said adhesive pattern comprising:

i. a first series of discrete seals disposed proximate to said first end;

ii. a second series of discrete seals disposed proximate to said first opposing longitudinal side edge; and iii. a third series of discrete seals disposed proximate to said second opposing longitudinal edge;

wherein at least one of said seals has a variable peel force that increases between said first and second ends of said package.

22. The package of claim 21, wherein said adhesive pattern further comprises a fourth series of discrete seals disposed proximate to said second end.

23. The package of claim 21, wherein the angular relation between any two seals within a series is obtuse or acute.

24. The package of claim 21, wherein the angular relation between a discrete seal of the first series in closest proximity to a discrete seal of the second series and the discrete seal of the second series is obtuse.

* * * * *